US007918454B2

(12) United States Patent
Imboden

(10) Patent No.: US 7,918,454 B2
(45) Date of Patent: Apr. 5, 2011

(54) INTERACTIVE BOTTLE GAME

(75) Inventor: Ethan Frederic Imboden, San Francisco, CA (US)

(73) Assignee: Jimmyjane, Inc., San Francisco, CA (US)

( * ) Notice: Subject to any disclaimer, the term of this patent is extended or adjusted under 35 U.S.C. 154(b) by 56 days.

(21) Appl. No.: 12/323,871

(22) Filed: Nov. 26, 2008

(65) Prior Publication Data

US 2009/0166969 A1 Jul. 2, 2009

Related U.S. Application Data

(60) Provisional application No. 60/991,598, filed on Nov. 30, 2007.

(51) Int. Cl.
*A63F 9/16* (2006.01)
*A63F 9/00* (2006.01)

(52) U.S. Cl. ..... 273/141 R; 273/144 R; 273/144 B

(58) Field of Classification Search ..... 273/141 R, 273/141 A, 139, 144 A, 144 B
See application file for complete search history.

(56) References Cited

U.S. PATENT DOCUMENTS

| | | | | |
|---|---|---|---|---|
| 265,100 | A | | 9/1882 | Kehoe et al. |
| 840,934 | A | | 1/1907 | Grant |
| 1,289,218 | A | | 12/1918 | Maiden |
| 1,586,983 | A | | 6/1926 | Farquhar |
| 1,661,711 | A | | 3/1928 | Vaughan |
| 2,000,419 | A | | 5/1935 | Sarber |
| 2,216,526 | A | | 10/1940 | Watson |
| 2,361,580 | A | | 10/1944 | Waring |
| 2,574,398 | A | | 11/1951 | Krebeck |
| 3,129,528 | A | | 4/1964 | Gausewitz |
| 3,496,652 | A | | 2/1970 | Wolfner et al. |
| 3,547,436 | A | | 12/1970 | Breslow ..... 273/1 |
| 3,901,512 | A | | 8/1975 | Fekete ..... 273/134 AE |
| 4,004,811 | A | | 1/1977 | Brandin ..... 273/135 |
| 4,027,877 | A | | 6/1977 | Breslow et al. ..... 273/1 R |
| 4,036,493 | A | | 7/1977 | Breslow ..... 273/1 M |
| 4,183,529 | A | * | 1/1980 | Hynson ..... 375/257 |
| 4,270,774 | A | * | 6/1981 | Barnes ..... 283/62 |
| 4,288,077 | A | | 9/1981 | Rose et al. ..... 273/246 |
| 4,655,461 | A | | 4/1987 | Capri et al. ..... 273/249 |
| 4,842,140 | A | | 6/1989 | Mesnard ..... 206/457 |
| 5,056,659 | A | | 10/1991 | Howes et al. ..... 206/217 |
| 5,335,912 | A | | 8/1994 | Brooks ..... 273/144 B |
| 5,503,274 | A | | 4/1996 | Toffler et al. ..... 206/457 |
| 5,664,671 | A | | 9/1997 | Nedblake, Jr. ..... 206/217 |
| 5,769,263 | A | | 6/1998 | Willingham et al. ..... 220/522 |
| 5,873,477 | A | | 2/1999 | Jago ..... 215/372 |
| D419,202 | S | | 1/2000 | Johns ..... D21/371 |
| 6,053,497 | A | * | 4/2000 | Such ..... 273/138.1 |
| 6,092,658 | A | | 7/2000 | Pietrafesa ..... 206/457 |
| 6,926,274 | B1 | | 8/2005 | Portella ..... 273/141 R |

OTHER PUBLICATIONS

*Original Message In A Bottle™ Shop*, www.sostotheworld.com/lovemessageinabottle.htm; Website Copyright 2004 (Nov. 1, 2007) pp. 1-2.

* cited by examiner

*Primary Examiner* — Benjamin H Layno
(74) *Attorney, Agent, or Firm* — Winston & Strawn LLP

(57) ABSTRACT

An entertaining and romantic game comprises actions and adventures of different categories that are placed in a bottle and spun. Some actions or adventures are pre-printed whereas others are created by the players, thereby personalizing the game.

7 Claims, 2 Drawing Sheets

INTERACTIVE BOTTLE GAME

CROSS-REFERENCE TO RELATED APPLICATIONS

This application claims the benefit of U.S. provisional patent application No. 60/991,598, filed Nov. 30, 2007 and is incorporated in its entirety by reference as if fully set forth herein.

BACKGROUND OF THE INVENTION

The application relates generally to an interactive game, and more specifically to a game involving unknown actions or adventures of a romantic nature.

Although various different types of games are available on the market, they often involve complicated rules and equipment and cater to younger audiences.

The pressures of the daily grind tend to limit the time and energy spent on maintaining excitement and adventure in relationships. Therefore, there exists a need for fun and playful entertainment to spark up one's love life in a hectic world.

SUMMARY OF THE INVENTION

An entertaining and romantic game comprises actions and adventures of different categories that are placed in a bottle and spun. At least some of the actions or adventures are created by one of the players, thereby personalizing and adding diversity to the game. The pressures of the daily grind tend to limit the time and energy spent on maintaining excitement and adventure in relationships, and people will more freely embark on an action or adventure if instructed by the game rather than discussed in conversation. In this way, the game acts as a kind of an icebreaker or social lubricant.

One embodiment relates to a method of playing a game. The method comprises providing a bottle, providing a first plurality of gameplay strips comprising a unique gameplay action on each strip of the first plurality, providing a second plurality of gameplay strips comprising blank strips, instructing the gameplayers to write down ideas for gameplay actions on the blank strips of the second plurality, instructing the gameplayers to insert the gameplay strips of the first and second plurality into the bottle, instructing the gameplayers to place the bottle between the gameplayers and spin the bottle in order to select one of the gameplayers, and finally instructing the selected gameplayer to draw a strip of the first and second plurality of strips previously inserted into the bottle, and to perform the action indicated on the drawn slip.

DETAILED DESCRIPTION OF THE PREFERRED EMBODIMENTS

Figure 1:
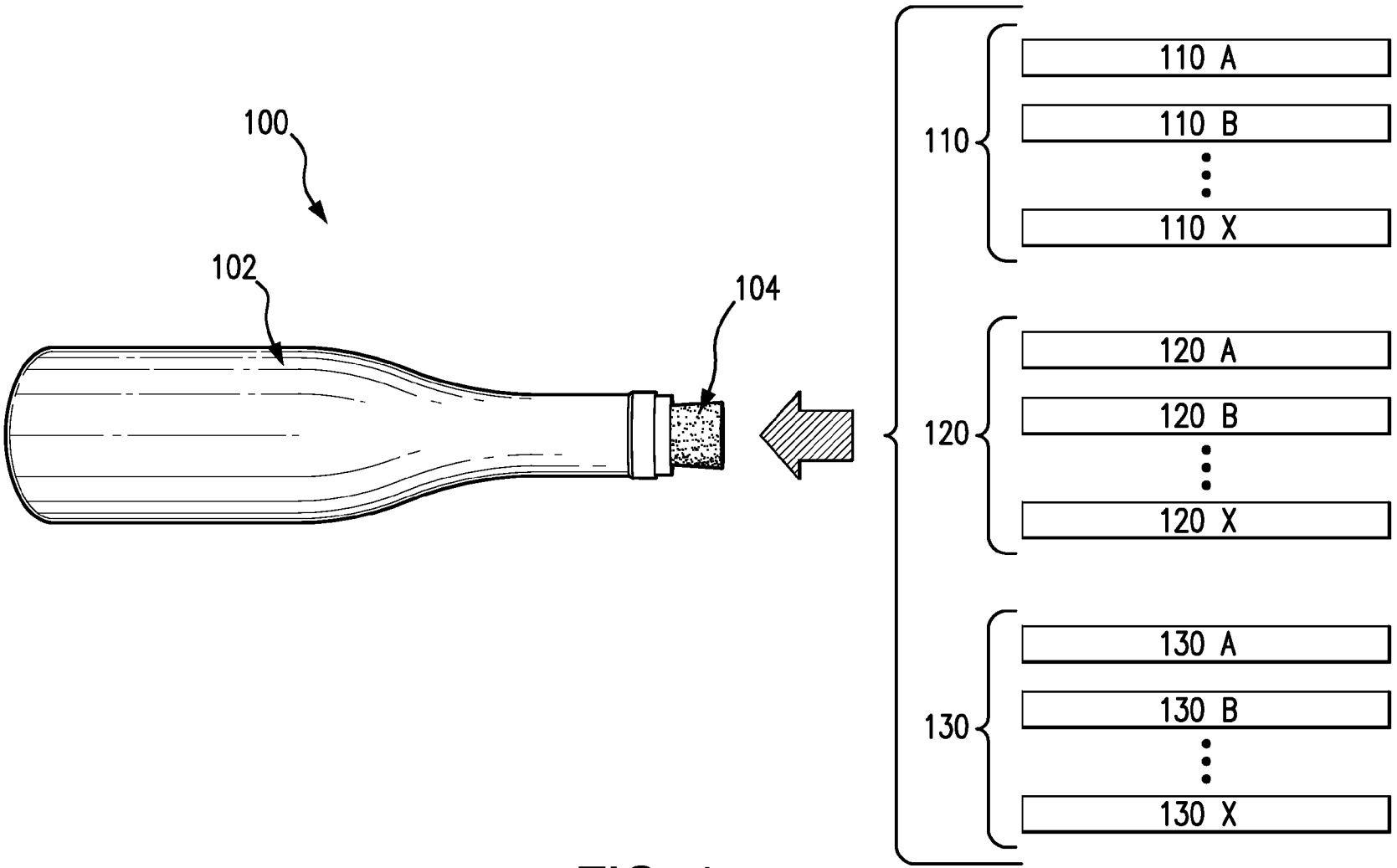
FIG. 1 illustrates a game according to an embodiment of the present invention.

FIG. 1 illustrates game 100. Game 100 comprises bottle 102, bottle closure 104 and action/adventure strips that are placed within the bottle 102. The strips are preferably in two or more different categories or genres. The strips are of such a dimension that they can easily be placed within the opening of the bottle before bottle closure 104 is put in place and the bottle is spun. Bottle 102 is also conveniently the packaging for the game. The game is delivered corked or capped with the game pieces inside and a sheet of instructions. In certain embodiments, the instructions may alternatively be printed on the bottle. Bottle 102, is preferably opaque so that the strips cannot be read when they are within the bottle. For example, bottle 102 may be painted or otherwise coated, or can be made from an opaque material, such as many types of plastic, ceramic, metal or the like.

Different groups of strips with actions relating to different categories may be provided and placed within the bottle. For example, a first category and group 110 of strips 110A-X may be of one generally recognized category, whereas a second group 120 of strips 120A-X may be of a second generally recognized category and additional groups (not shown) of strips pertaining to additional categories may be provided.

In one preferred embodiment, one category of strips is a "do it yourself" category, wherein the players write down their own ideas for actions or adventures and then place them inside the bottle. This adds a personal touch to the game and makes for a more compelling and intimate experience created by and tailored to the particular people playing. This is especially interesting when the categories and general environment are of a romantic or sexual nature.

Group 130 of strips 130A-X represent the "do it yourself" category of strips. On each of strips 130A-X, game players write down an action or adventure they believe would be interesting to perform or have another game player perform.

Do it yourself strips 130 may be supplied individually or on perforated sheets. When supplied in perforated sheets the strips can be written upon when still connected to the larger sheet, thus making writing on them easier in comparison to individual strips. In an embodiment, the "do it yourself" category of strips 130 can be provided as one or more pads of appropriately sized pieces of paper, attached together in a stack or other assembly such that the uppermost piece of paper can be comfortably written on by a user and torn off the pad for incorporation into the game. Strips 110 and 120 may be similarly provided. Strips 130 may also be erasable and re-writable. If made of metal, plastic or wood, certain strip embodiments may have re-writable surfaces of an easy to read color. e.g. white adhered to them.

All of the strips may be made of paper, plastic, cardboard, metal, wood or other similar material. Whatever the material, the strips are preferably sufficiently rigid to be easily accessible by tilting the opening of bottle downward relative to the body of the bottle. The ratio of mass to surface area is also tailored to allow the strips to easily exit a readily available bottle such as a wine bottle, with either the force of gravity or a gentle shake. In one embodiment, the strips are made of aluminum, for example 6061 or 6063 and are 6" long×3/16" wide×1/4" deep.

Figure 2:
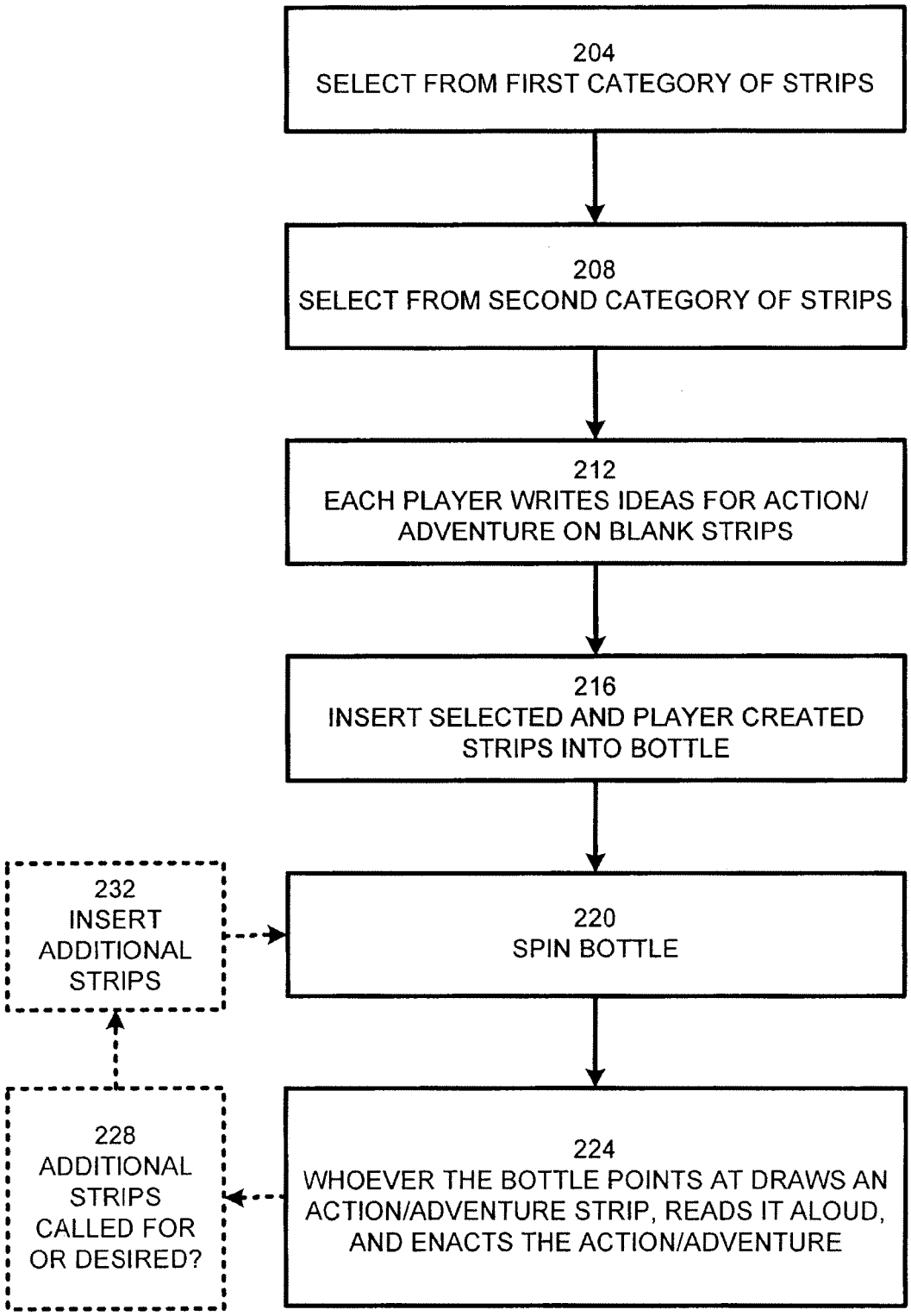
FIG. 2 is a flowchart of some steps of the game shown in FIG. 1.

FIG. 2 is a flowchart of the main steps of an embodiment of the invention. In step 204, one or more of the players selects a group of strips from a first category of strips such as category 110. For example, the players select 5 first category strips to be placed into the bottle. While the first category may be any generally recognized category, in one embodiment it is a "G-rated" or "PG rated" category. The average person is familiar with the motion picture rating system, including the G and PG ratings, however, the following description of the motion picture rating system, used as an example of generally recognized categories, is included for reference below.

Exemplary Motion Picture Categories

A G-rated motion picture contains nothing in theme, language, nudity, sex, violence or other matters that, in the view of the Rating Board, would offend parents whose younger children view the motion picture. The G rating is not a "certificate of approval," nor does it signify a "children's" motion picture. Some snippets of language may go beyond polite conversation but they are common everyday expressions. No stronger words are present in G-rated motion pictures. Depictions of violence are minimal. No nudity, sex scenes or drug use are present in the motion picture.

A PG-rated motion picture should be investigated by parents before they let their younger children attend. The PG rating indicates, in the view of the Rating Board, that parents may consider some material unsuitable for their children, and parents should make that decision. The more mature themes in some PG-rated motion pictures may call for parental guidance. There may be some profanity and some depictions of violence or brief nudity. But these elements are not deemed so intense as to require that parents be strongly cautioned beyond the suggestion of parental guidance. There is no drug use content in a PG-rated motion picture.

An R-rated motion picture, in the view of the Rating Board, contains some adult material. An R-rated motion picture may include adult themes, adult activity, hard language, intense or persistent violence, sexually-oriented nudity, drug abuse or other elements, so that parents are counseled to take this rating very seriously. Children under 17 are not allowed to attend R-rated motion pictures unaccompanied by a parent or adult guardian. Parents are strongly urged to find out more about R-rated motion pictures in determining their suitability for their children. Generally, it is not appropriate for parents to bring their young children with them to R-rated motion pictures.

An NC-17 rated (previously and more commonly referred to as an X-rated) motion picture is one that, in the view of the Rating Board, most parents would consider patently too adult for their children 17 and under. No children will be admitted. NC-17 does not mean "obscene" or "pornographic" in the common or legal meaning of those words, and should not be construed as a negative judgment in any sense. The rating simply signals that the content is appropriate only for an adult audience. An NC-17 rating can be based on violence, sex, aberrational behavior, drug abuse or any other element that most parents would consider too strong and therefore off-limits for viewing by their children.

These ratings should only serve as guidelines, and people's perceptions of what constitutes a generally accepted category may differ from those above, and in general may differ from each other.

Returning to FIG. 2, in step 208 the players then select from a second category of strips. For example, the players would again select 5 strips to be placed within the bottle. Category 2 strips, may be, for example, R-rated action/adventure strips. Note that step 208 is optional and that the pre-printed strips may be considered one category as compared to the player created strips discussed below, with the different types of pre-printed strips considered sub categories.

In step 212, each of the players writes down his or her ideas for actions/adventures on blank strips. This group of strips corresponds to group 130 of FIG. 1. This third category, in this case of do it yourself strips, may for example be X-rated actions one wishes to perform or have performed. Again, as an example, 5 strips of this third category may be made.

Note that the same number of strips is described as being made or selected for each category. The number and ratio of total strips may of course vary and this is only provided as an example. The number of strips, and the size of the individual strips may also vary depending on the size and geometry of the strips and the bottle, as well as the other physical characteristics of the strips. Note also that the strips need not be unique, as there may be redundant strips provided and chosen.

In step 216 all of the selected and player created strips are inserted into the bottle and the bottle is capped or closed. Then in step 220 the bottle is spun by one of the players. When the bottle stops spinning, whoever the bottle is pointing at opens the bottle, draws one strip, and then performs or enacts the action or adventure listed on the strip.

In one embodiment, instructions can be written during the game, after turns have been taken and the bottle has been spun one or more times. For example, in option step 228, one of the actions or adventures drawn in step 224 may call for additional actions or adventures to be written down as part of the initial action or adventure. Thus the player could select or concoct an additional adventure in optional step 232, place in into the bottle and spin again in step 220. Of course, even if additional strips are not called for, turns are repeatedly taken until the players all the strips are drawn, or the players decide to cease gameplay.

The above description of embodiments of the invention should not serve to limit the scope of the invention recited in the appended claims.

What is claimed is:

1. A kit, comprising:

an elongated bottle including an interior cavity and an open end in communication with the cavity, wherein the elongated bottle is capable of being place on its side on a flat surface with the open end pointing substantially horizontally, and the elongated bottle being capable to turn on its side about a vertical axis;

a stopper configured to be removably affixed in the open end of the bottle a first plurality of game strips, wherein each of the first plurality of game strips has a pre-printed action instruction thereon; and a second plurality of game strips, wherein the second plurality of game strips is blank;

wherein the first and second plurality of game strips are configured to pass through the opening of the bottle without substantial deformation thereof, each of the first and second plurality of game strips are further configured for self-alignment with respect to the opening of the bottle such that a long axis of a game strip is substantially perpendicular to the opening, each of the first and second plurality of game strips has a length and a width such that the width is smaller than the opening of the bottle, and wherein the length is larger than the opening of the bottle, and an interior cavity of the bottle has a tapered neck portion that transitions into the opening of the bottle, and wherein the tapered neck portion facilitates the self-alignment of the first plurality of game strips.

2. The kit of claim 1, further comprising a set of pre-printed instructions, the pre-printed instructions comprising:

an instruction to devise and describe at least one gameplay instruction in written form on at least one of the second plurality of game strips;

an instruction to insert at least some of the first plurality of game strips into the bottle;

an instruction to insert at least some of the second plurality of game strips into the bottle;

an instruction to place the bottle on a surface and impart rotational motion thereon; and an instruction to select one gameplayer from a plurality of gameplayers based on a resting position of the bottle once the rotational motion thereof stops, wherein the selected gameplayer is instructed to take a turn comprising:

removing a game strip from the bottle; and performing the gameplay instruction indicated on the game strip.

3. The kit of claim 2, wherein the set of pre-printed instructions is printed on an outside surface of the bottle.

4. The kit of claim 1, wherein the second plurality of game strips are included on a perforated sheet of material.

5. The kit of claim 1, wherein the second plurality of game strips are assembled together in the form of a pad of removable paper sheets.

6. The kit of claim 1, wherein the first plurality of game strips comprise game strips of a first category of actions.

7. The kit of claim 1, wherein the first plurality of game strips comprise game strips of a second category of actions.

* * * * *